US009545154B2

(12) United States Patent
Duke

(10) Patent No.: US 9,545,154 B2
(45) Date of Patent: Jan. 17, 2017

(54) PIVOTING SHELF

(71) Applicants: INTERSECTION COLLABORATIVE INC., Orangeville (CA); ERGO-INDUSTRIAL SEATING SYSTEMS INC., Mississauga (CA)

(72) Inventor: Aaron Duke, Orangeville (CA)

(73) Assignee: ERGO-INDUSTRIAL SEATING SYSTEMS INC., Mississauga, ON (CA)

( * ) Notice: Subject to any disclaimer, the term of this patent is extended or adjusted under 35 U.S.C. 154(b) by 0 days.

(21) Appl. No.: 14/457,932

(22) Filed: Aug. 12, 2014

(65) Prior Publication Data

US 2015/0041421 A1 Feb. 12, 2015

Related U.S. Application Data

(60) Provisional application No. 61/865,035, filed on Aug. 12, 2013.

(51) Int. Cl.
*A47F 5/08* (2006.01)
*A47B 96/02* (2006.01)
(Continued)

(52) U.S. Cl.
CPC ..... *A47B 96/028* (2013.01); *A47B 5/00* (2013.01); *A47B 96/061* (2013.01)

(58) Field of Classification Search
CPC ... A47B 46/005; A47B 96/028; A47B 96/061; A47B 5/04; A47F 5/08; A47C 9/06
(Continued)

(56) References Cited

U.S. PATENT DOCUMENTS 94,598 A 9/1869 Henth
577,010 A 2/1897 Cundy
(Continued)

FOREIGN PATENT DOCUMENTS

CA 2616546 A1 6/2009
CN 201875397 U 6/2011
(Continued)

OTHER PUBLICATIONS

Bobrick Washroom Equipment, Inc., Document B-287_td•I.pdf(Technical Data Sheet), Apr. 27, 2011, http://www.bobrick.com/washroomaccessories/Pages/ProductDetails.aspx?Product+Number%3DB-287.
(Continued)

*Primary Examiner* — Joshua Rodden
*Assistant Examiner* — Kimberley S Wright
(74) *Attorney, Agent, or Firm* — Millman IP Inc.

(57) ABSTRACT

A shelf assembly includes a shelf and a mounting structure for mounting the shelf on a substantially vertical surface. The shelf is pivotably mounted on the mounting bracket proximate the rear end and pivots from an open position to a closed position and from the closed position to the open position. An engagement structure on the shelf, which may optionally be positioned proximate the rear end of the shelf, is configured so that a force applied to the engagement structure when the shelf is in the closed position will urge the shelf toward the open position. The shelf assembly is particularly useful in hospital settings where hospital staff need to open and close the shelf without the use of their hands.

12 Claims, 10 Drawing Sheets

(51) Int. Cl.
*A47B 96/06* (2006.01)
*A47B 5/00* (2006.01)

(58) Field of Classification Search
USPC ..... 211/150, 59.4; 108/108, 152, 2, 134, 48
See application file for complete search history.

(56) References Cited

U.S. PATENT DOCUMENTS 755,668 A * 3/1904 Hurxthal ..... 248/480
1,576,034 A * 3/1926 Butt ..... 108/134
2,835,522 A * 5/1958 Serto ..... 16/390
2,905,424 A * 9/1959 Snow ..... 248/240.4
2,950,820 A * 8/1960 Shiels ..... 108/2
3,045,831 A * 7/1962 Pendergrast, Jr. et al. .. 211/59.4
3,364,885 A * 1/1968 Brothers ..... 108/134
4,488,497 A 12/1984 Bevans
4,580,832 A * 4/1986 Maruyama et al. ..... 297/14
4,702,176 A 10/1987 Goshow
4,712,692 A 12/1987 Pensipp
5,022,539 A * 6/1991 Rushing et al. ..... 211/132.1
5,528,993 A * 6/1996 Vincelli ..... 108/48
5,590,427 A * 1/1997 Weterings et al. ..... 4/611
5,927,519 A 7/1999 Koonts et al.
6,065,251 A * 5/2000 Kindrick ..... 52/36.4
6,305,741 B1 * 10/2001 Fernandez ..... 297/14
RE37,712 E 5/2002 Gannon
6,450,599 B1 * 9/2002 Mamuyac ..... 312/313
6,487,979 B2 * 12/2002 Ash et al. ..... 108/44
6,807,690 B1 * 10/2004 Satterfield ..... 4/578.1
6,837,467 B2 * 1/2005 Cheng ..... 248/240
6,845,870 B2 1/2005 Yang
7,080,417 B2 * 7/2006 Jiang ..... 4/578.1
7,240,963 B2 * 7/2007 Stanley ..... 297/217.7
7,367,616 B2 * 5/2008 Summerford ..... 297/14
7,757,615 B2 * 7/2010 McDonald et al. ..... 108/108
7,814,843 B2 * 10/2010 Chen et al. ..... 108/42
7,832,803 B2 11/2010 Cassaday
8,267,017 B1 * 9/2012 Michael et al. ..... 108/42
8,333,158 B2 * 12/2012 Wise ..... 108/134
8,567,325 B1 * 10/2013 Hlatky et al. ..... 108/134
8,607,995 B1 * 12/2013 Mladinich ..... 211/119.004
8,919,715 B2 * 12/2014 Terada ..... 248/235
2001/0035114 A1 * 11/2001 Ash et al. ..... 108/147
2004/0124327 A1 * 7/2004 Cheng ..... 248/244
2004/0261667 A1 12/2004 Ma
2005/0211140 A1 * 9/2005 McDonald et al. ..... 108/108
2006/0071510 A1 * 4/2006 Jiang ..... 297/14
2006/0186389 A1 * 8/2006 Stanley ..... 256/1
2007/0012637 A1 * 1/2007 Yu et al. ..... 211/96
2007/0035166 A1 * 2/2007 Summerford ..... 297/331
2009/0173705 A1 * 7/2009 Stingel et al. ..... 211/150
2009/0300884 A1 12/2009 Morgan et al.
2009/0308287 A1 * 12/2009 Chen et al. ..... 108/42
2011/0266403 A1 * 11/2011 Terada ..... 248/205.1
2012/0037583 A1 * 2/2012 Wise ..... 211/150
2015/0183360 A1 * 7/2015 Mowry et al.
2015/0366338 A1 * 12/2015 Conod
2015/0366409 A1 * 12/2015 Cohen et al.

FOREIGN PATENT DOCUMENTS

JP 3111639 U 7/2005
WO 2010090171 A1 8/2010

OTHER PUBLICATIONS

PCT/CA2014/000613, International Search Report, Nov. 13, 2014.

* cited by examiner

PIVOTING SHELF

CROSS-REFERENCE TO RELATED APPLICATIONS

This application claims the benefit of U.S. Provisional Patent Application No. 61/865,035, filed Aug. 12, 2013, the contents of which are incorporated by reference as if fully set forth in detail herein.

FIELD OF THE INVENTION

The present invention relates to shelves, particularly to shelves mountable on a vertical surface.

BACKGROUND OF THE INVENTION

In a medical facility, such as a hospital, a long term care facility, a medical clinic, a veterinary clinic, the chance of spreading contagions from one patient to another is particularly high as personnel circulate from room to room on a regular basis. Every effort is made to reduce the chance that such contagions, especially highly virulent ones, are not transmitted from patient to patient. As part of this effort, hospitals, for example, are increasingly requiring staff to use bactericidal hand sanitizers before entering any room. To this end, wall-mounted hand sanitizers are being installed outside each room beside the room's door. However, it can be difficult for hospital staff to make use of such hand sanitizers because their hands are often occupied carrying medical charts and other hospital paraphernalia. To facilitate compliance with hospital policy to use hand sanitizers before and after entering a patient's room some hospital staff place their charts and paraphernalia on carts that may be nearby. Such carts, however, are primarily for use in transporting drugs and other items between locations in the hospital (e.g. between a nursing station and a patient's room), and as such cannot be relied upon to be left near hand sanitizer stations. Additionally, these carts are expensive and are not provided in sufficient numbers to be placed near each hand sanitizer station. Yet another problem with such carts is that they intrude into the available space in a corridor of the facility.

There is a need for a solution that at least partially avoids one or more of these problems.

SUMMARY OF THE INVENTION

There is provided a shelf assembly comprising: a shelf; and, a mounting bracket for mounting the shelf on a substantially vertical surface, the shelf pivotably mounted on the mounting bracket proximate a rear end of the shelf, the shelf pivotable from an open position to a closed position and from the closed position to the open position, the shelf comprising an engagement structure proximate the rear end configured so that a force applied to the engagement structure when the shelf is in the closed position will urge the shelf toward the open position.

There is further provided a method of assembling a shelf assembly, comprising: inserting a first portion of a torque insert into a shelf between an upper and lower surface of the shelf; placing a cap on a second portion of the torque insert, the second portion protruding from the shelf when the first portion is inserted into the shelf; placing the shelf with the torque insert and cap onto a mounting bracket affixed to a substantially vertical surface; and, securing the cap to the mount.

The open position is preferably a substantially horizontal working position, where the shelf extends in a substantially perpendicular direction to the vertical surface. The closed position is preferably a substantially upwardly or downwardly vertical storage position, where the shelf is substantially parallel to the vertical surface. Preferably, the closed position is substantially upwardly vertical. In some embodiments, the shelf may be held at one or more intermediate positions between the closed and open positions.

The shelf may have a top, a bottom, a rear end and a front end. The shelf may be solid or hollow. The shelf may be a single piece of material or comprised of parts that fit together, for example upper and lower halves that snap together. The shelf may comprise one or more apertures, cavities and/or passageways to house one or more pivot mechanisms. The shelf may be of any suitable shape and/or size. One or more surfaces of the shelf may comprise raised edges to form a receptacle for holding items.

The shelf pivots on a pivot mechanism. The pivot mechanism may comprise, for example, one or more pins, projections, protrusions and the like associated with the shelf and/or the mount. When associated with the shelf, the pivot mechanism may be on an exterior surface of the shelf and affixed thereto, and/or housed partially or wholly within a cavity or passageway in the shelf. The pivot mechanism may further comprise one or more cushioning or damping structures to cushion movement of the shelf at least from the closed position to the open position, thereby reducing potential impact stresses on the shelf assembly and impact noise when the shelf reaches the open position after pivoting. The damping structure may also cushion movement of the shelf from the open position to the closed position. The damping structure is preferably associated with the pivot mechanism. In one embodiment the cushioning structure comprises a damping hinge.

The cushioning structure may comprise any suitable resistive-force-exerting member for resisting pivoting of the shelf, for example a mechanical spring, a fluid transfer structure, such as a piston and cylinder containing a fluid (e.g. air or water), or a torque insert. A torque insert is particularly preferred, and one example of such an insert is described in United States Reissued patent U.S. RE37712, reissued on May 28, 2002, the entire contents thereof incorporated herein by reference. In another embodiment, the pivot mechanism could permit a single application of force to initiate pivoting of the shelf toward the open position and/or closed position, while completion of the pivoting is accomplished automatically in a controlled manner. Such automatic slow-close mechanisms are commercially available. Examples include the 1000 Series, 2000 series and 3000 series damping hinges, sold by Hanaya, Inc. of Ponte Vedra, Fla., in the United States.

In another embodiment, the pivot mechanism could comprise a structure (e.g. a torsion spring, a hydraulic cylinder or spring and the like) that resists pivoting of the shelf from the closed position to the open position and that continuously biases the shelf towards the closed position. In this embodiment, when the shelf is forced into the open position, cooperating securement members may be used to secure the shelf in the open position. Securement members may include, for example, hooks, catches, bolts or magnetic members with sufficient strength to resist the biasing force. Release of the securement members allows the shelf to automatically return to the closed position under the force of the bias. The securement members are preferably a magnet secured to one of the shelf and the mounting bracket and a corresponding magnetically attracted member (e.g. a ferromagnetic or ferromagnetic member or another magnet) on the other of the shelf and the mount.

In an embodiment, the shelf pivots downwardly from the closed position to the open position and upwardly from the open position to the closed position. In this embodiment, the engagement structure is preferably on the bottom of the shelf as it is the bottom that extends outwardly from the substantially vertical surface when the shelf is in the closed position. Further, in this embodiment, there is preferably a stop that prevents the shelf from pivoting downwardly from the open position. The stop may be any suitable mechanism known in the art, for example, the rear end of the shelf may abut the substantially vertical surface and/or the mounting bracket when the shelf is in the open position, a protrusion may abut the substantially vertical surface and/or the mounting bracket when the shelf is in the open position, a cam may be present on a pivot mechanism to prevent rotation beyond a certain point, and/or a cable of appropriate length may be secured to the substantially vertical surface and the shelf. In a particularly preferred embodiment, the rear end of the shelf abuts the substantially vertical surface and/or the mounting bracket when the support surface is in the open position to prevent the support surface from pivoting downwardly from the open position. The rear end of the shelf may comprise an abutment structure for this purpose. In a particularly preferred embodiment, the mounting bracket comprises an abutment face on which the rear end of the shelf abuts. It is preferable not to use support cables, arms and the like in order to reduce the number of sharp edges and catch points on the shelf assembly.

In one embodiment, the engagement structure is configured so that the force applied to the engagement structure to urge the shelf toward the open position is a downward force. While the engagement structure may be an add-on to the shelf, the engagement structure is preferably monolithic with the shelf. The engagement structure may comprise depressions (e.g. channels, indentations, grooves, holes, and/or the like) in the shelf, or, more preferably, one or more protrusions (e.g. knobs, ridges, arms and/or the like) extending from the shelf. The engagement structure may comprise a combination of one or more depressions and one or more protrusions. In one particularly preferred embodiment, the engagement structure comprises a ridge extending proximate a first side of the shelf to proximate a second side of the shelf. The engagement surface is preferably designed so that many different parts of a person's body may be readily used to apply the force, for example a person's hand, forearm, elbow, shoulder, hip, knee or foot. Since a person's hands will often be occupied holding other articles when it is desired to open the shelf, it is especially useful if the force may be applied to the engagement structure with a body part other than the hand, especially the elbow. In a preferred embodiment, the engagement structure is configured for an elbow. In one embodiment, the shelf comprises more than one engagement structure so that a person may use the most convenient one in any given circumstance.

The shelf is mountable on the substantially vertical surface, for example a wall, post, door and the like, by a mount. The mounting bracket may be secured to the vertical surface by any suitable method, for example, with screws, nails, bolts or adhesives (e.g. glue or tape) or magnetically. The mounting bracket may comprise a bearing surface for supporting the shelf. In one embodiment, the mounting bracket may comprise spaced-apart mounting ears for supporting the shelf. In one embodiment, the shelf may comprise one or more support projections. The support projections may be supported directly by the mount, for example by the mounting ears, or the support projections may be covered by caps adapted to receive the support protections on bearing surfaces in the caps. The caps may be mounted to the mount, for example secured to the mounting ears. The caps and/or support projections may serve to seal the cushioning structure against debris entering into the cushioning structure. To facilitate repair and servicing, the shelf may be removable from the shelf assembly without removing the mounting bracket from the vertical surface.

The shelf assembly is particularly useful in hospital settings where hospital staff need to open and close the shelf without the use of their hands if they are holding items such as medical charts relating to their patients. The shelf assembly may be made of any suitable material, for example plastics, particularly plastics that resist the growth of bacteria and other microorganisms.

In another embodiment the invention relates to a method of use of a shelf assembly including a shelf pivotally supported on a mounting bracket, including:

pivoting the shelf using a region of one's arm elbow proximate the elbow from a closed position in which the shelf extends upwards, to an open position in which the shelf extends generally horizontally;

placing at least one hand-carried object on the shelf;

cleaning one's hands;

removing the at least one object from the shelf; and lifting the shelf from the open position to the closed position. The shelf is preferably one of the shelves described in this specification.

In another embodiment, a shelf assembly is provided, comprising, a mounting bracket that is mountable to a substantially vertical surface, a shelf and a torque insert (and in some embodiments, two torque inserts). The shelf is pivotably mounted to the mounting bracket for movement about a shelf pivot axis proximate a rear end of the shelf. The shelf is pivotable upwardly from an open, substantially horizontal position to a closed, substantially vertical position and downwardly from the closed position to the open position, wherein the shelf comprises an abutment member that abuts at least one of the substantially vertical surface and the mounting bracket to hold the shelf in the open position. The torque insert cushions pivoting of the shelf from at least the closed position to the open position. The torque insert is configured to exert a resistance force to lowering of the shelf to the open position such that over a selected range of angles of the shelf, the torque insert permits the shelf to fall to the open position under gravity. The torque insert includes a first portion connected to the shelf and a second portion connected to the mounting bracket. The first portion is pivotable with respect to the second portion about the shelf pivot axis. The shelf assembly is free of any arms or linkages connected between the shelf and the mounting bracket and between the shelf and the substantially vertical surface.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DETAILED DESCRIPTION OF PREFERRED EMBODIMENTS

In this specification and in the claims, the use of the article "a", "an", or "the" in reference to an item is not intended to exclude the possibility of including a plurality of the item in some embodiments of the invention. It will be apparent to one skilled in the art in at least some instances in this specification and the attached claims that it would be possible to include a plurality of the item in at least some embodiments of the invention.

A pivoting shelf assembly in accordance with an embodiment of the present invention is depicted in an open horizontal position in FIGS. 1A-1G and FIG. 3A and in a closed upwardly vertical position in FIGS. 2A-2G and FIG. 3B. The shelf assembly comprises a shelf 100 supported between bracket ears 201 of a mounting bracket 200. The shelf 100 comprises spaced-apart upper and lower surfaces, a front end, a rear end and two opposed side edges. The upper surface is shown at 105 of the shelf 100 and comprises a central depression 105*a* surrounded by a raised lip 105*b*.

The shelf 100 is pivotable around a shelf pivot axis A which is collinear with the pivot axes of two torque inserts 300 (FIGS. 4A, 4B and 7A and 7C) positioned in apertures in opposed sides of the shelf 100 proximate the rear end of the shelf 100. The torque inserts 300 together form a cushioning structure to cushion pivoting of the shelf 100 from the closed position to the open position.

Figure 1A:
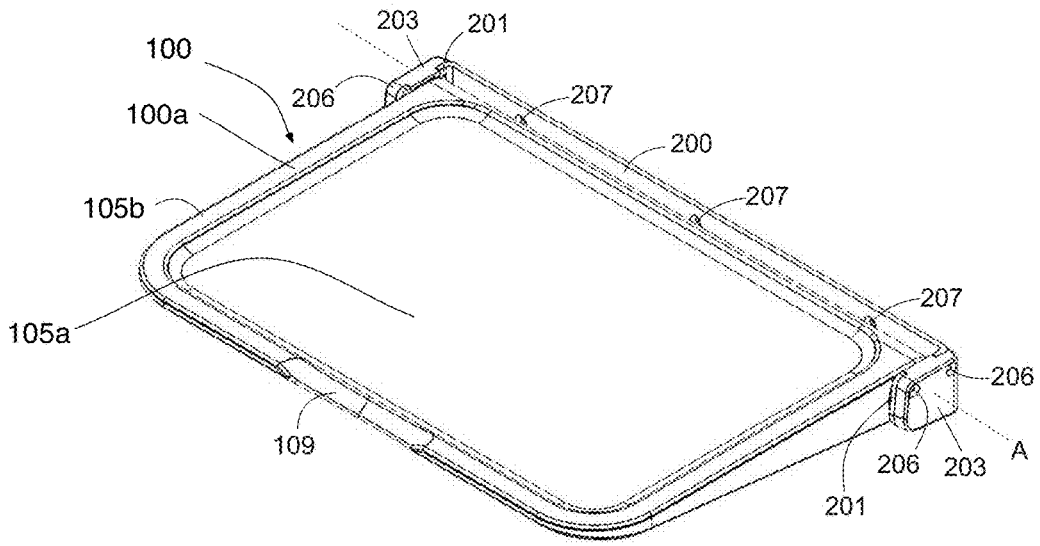
FIG. 1A is a top isometric view of a pivoting shelf assembly of the present invention in an open position.
Figure 1B:
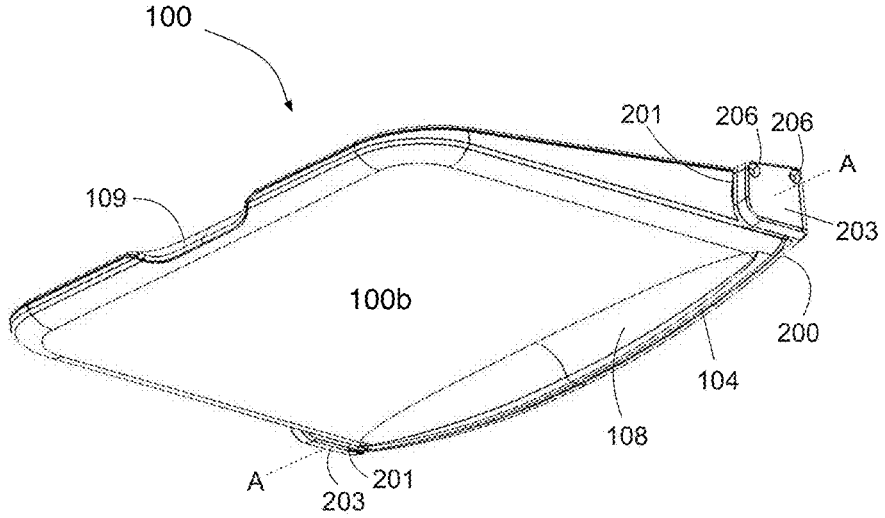
FIG. 1B is a bottom isometric view of the shelf assembly depicted in FIG. 1A.
Figure 1C:
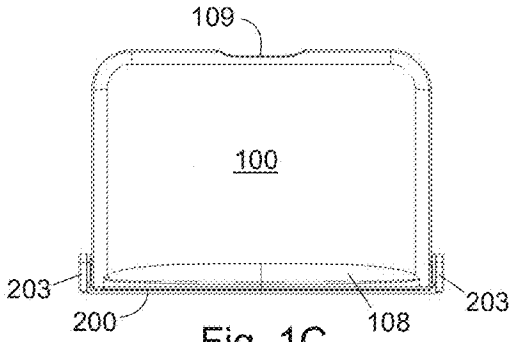
FIG. 1C is a bottom view of the shelf assembly depicted in FIG. 1A.
Figure 1D:
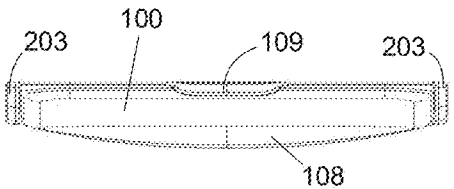
FIG. 1D is a front view of the shelf assembly depicted in FIG. 1A.
Figure 1E:
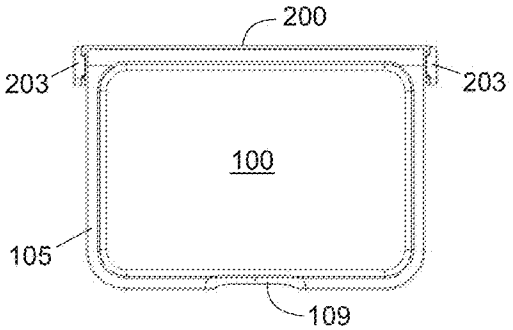
FIG. 1E is a top view of the shelf assembly depicted in FIG. 1A.
Figure 1F:
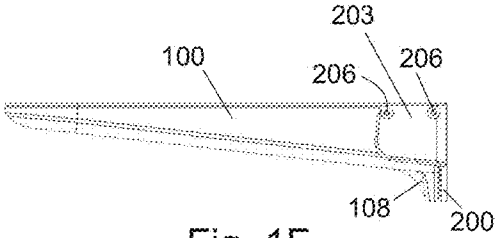
FIG. 1F is a side view of the shelf assembly depicted in FIG. 1A.
Figure 1G:
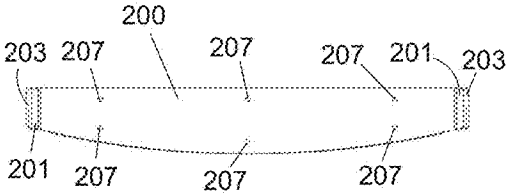
FIG. 1G is a rear view of the shelf assembly depicted in FIG. 1A.
Figure 2A:
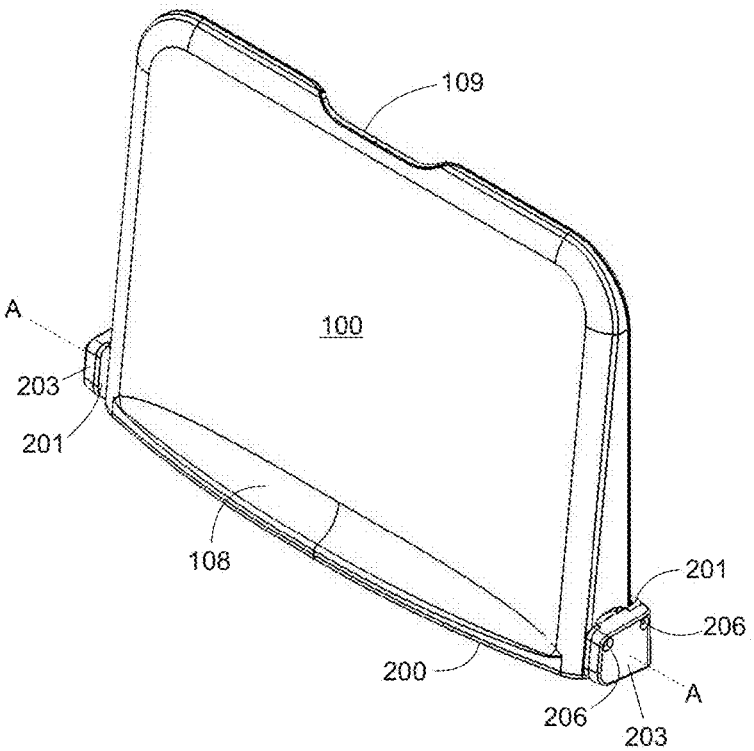
FIG. 2A is a top isometric view of the shelf assembly depicted in FIG. 1A in a closed position.
Figure 2B:
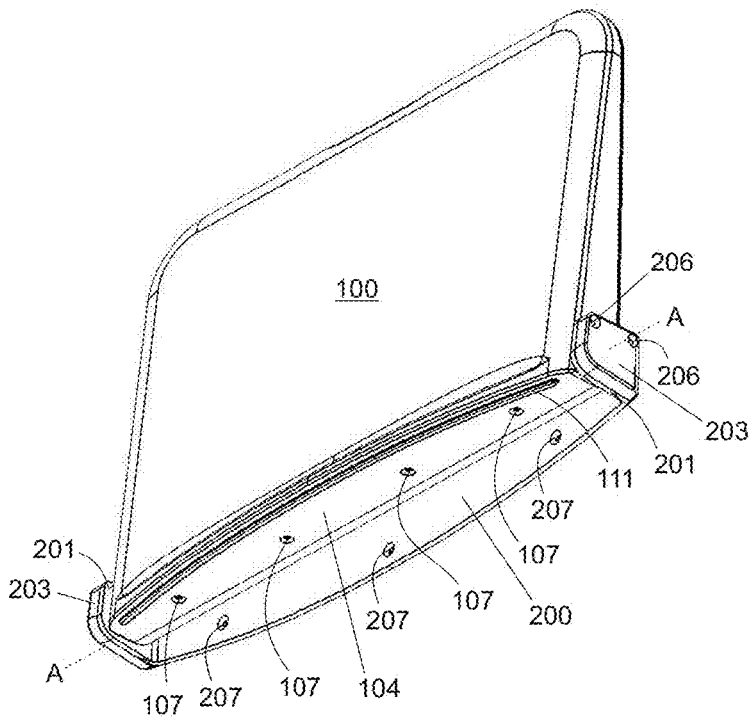
FIG. 2B is a bottom isometric view of the shelf assembly depicted in FIG. 2A.
Figure 2C:
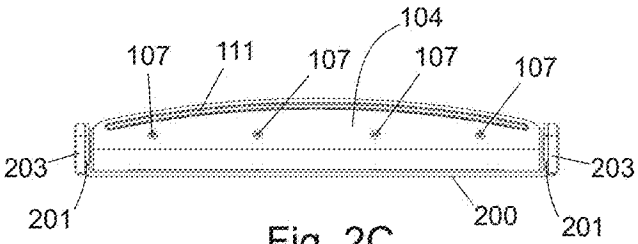
FIG. 2C is a bottom view of the shelf assembly depicted in FIG. 2A.
Figure 2D:
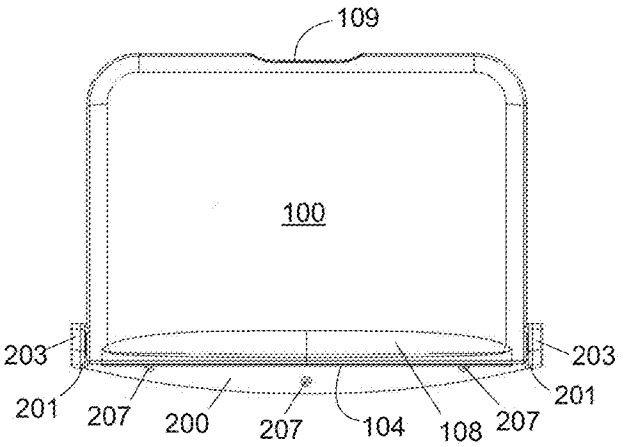
FIG. 2D is a front view of the shelf assembly depicted in FIG. 2A.
Figure 2E:
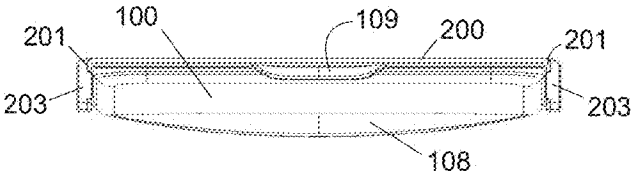
FIG. 2E is a top view of the shelf assembly depicted in FIG. 2A.
Figure 3B:
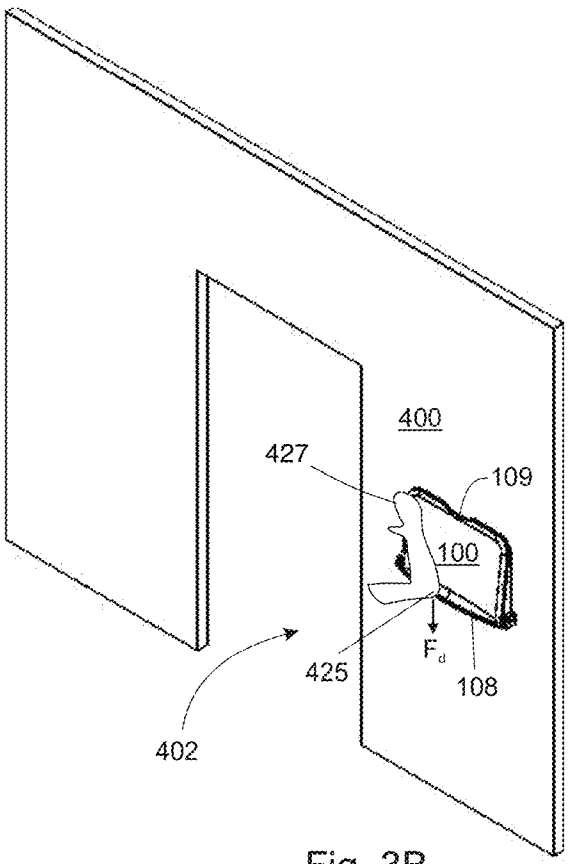
FIG. 3B is a top isometric view of the shelf assembly depicted in FIG. 1 and FIG. 2 mounted on a wall in the closed position.

The shelf 100 has two engagement structures thereon, which can receive an initial force to move the shelf 100 between positions. An integrally molded laterally extending ridge 108 protrudes from the lower surface of the shelf 100, optionally proximate the rear end of the shelf 100, and is sized to receive a person's elbow. A grip 109 is an indentation in the lip 105 at the edge of the front end of the upper surface of the shelf 100. As seen in FIGS. 2A-2E and FIG. 3B, when the shelf 100 is in the closed position the ridge 108 extends generally horizontally outward from the bottom surface of the closed shelf 100 and the grip 109 faces upwardly. With the shelf 100 in the closed position, both the ridge 108 and the grip 109 are available for engagement with a body part to initiate movement of the shelf 100 from the closed position to the open position. With reference to FIG. 3B, with the shelf assembly mounted on a substantially vertical surface (e.g. a wall 400) at an appropriate height next to a doorway 402, the ridge 108 may be somewhere between about 40 inches and about 48 inches from the floor and is thus well positioned for engagement with a person's elbow (shown at 425 in FIG. 3B), while the grip 109 is positioned for engagement with a person's hand. Application of a downward force $F_d$ to the ridge 108 for example by elbow 425 shown in FIG. 3B, or an outward and downward force to the grip 109 for example by a hand (shown at 427 in FIG. 3B), will initiate movement of the shelf 100 towards the open position.

Figure 2F:
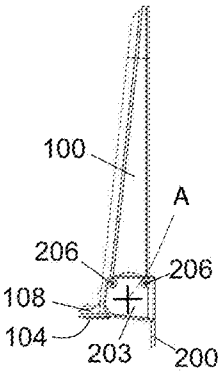
FIG. 2F is a side view of the shelf assembly depicted in FIG. 2A.
Figure 2G:
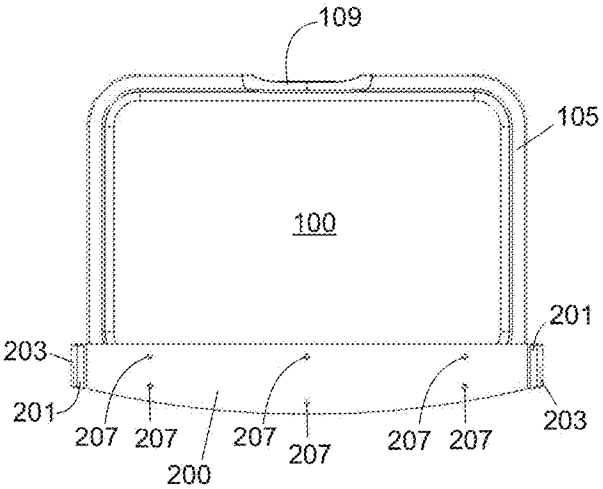
FIG. 2G is a rear view of the shelf assembly depicted in FIG. 2A.

With reference to FIG. 2F, by positioning the ridge 108 towards the rear end 104 of the shelf 100 the ridge 108 extends generally horizontally in front of the shelf pivot axis A when the shelf 100 is in the closed position. As a result, when a user places their elbow 425 on the ridge 108 to exert a generally downward force $F_d$ thereon (so as to open the shelf 100), there is a reduced likelihood that the vector angle of the user's force $F_d$ inadvertently urges the shelf 100 to remain in the closed position. In other words, there is a greater range of vector angles that are downwards and towards the wall wherein the elbow-applied force $F_d$ of the user will still exert a torque on the shelf 100 that urges the shelf 100 towards the open position. It will be understood that the ridge 108 need not be directly horizontally in front of the shelf pivot axis A, however. For example, in a preferred embodiment, the ridge 108 may be at any height that is not substantially above the pivot axis A. In a less preferred embodiment, the ridge 108 may be above the height of the pivot axis A, but may extend further outwards from the bottom face (shown at 113) of the shelf 100, so as to facilitate engagement by a user in a manner that offers greater control over the vector angle of the applied force by the user's elbow. In an embodiment, the ridge 108 extends not less than about 1.5 inches from the bottom face of the shelf 100. By placing the ridge 108 not substantially higher than the height of the pivot axis A, the ridge can project relatively little from the bottom face of the shelf 100 is possible while still providing a large range of vector angles for the elbow-applied force to be exerted.

Figure 3A:
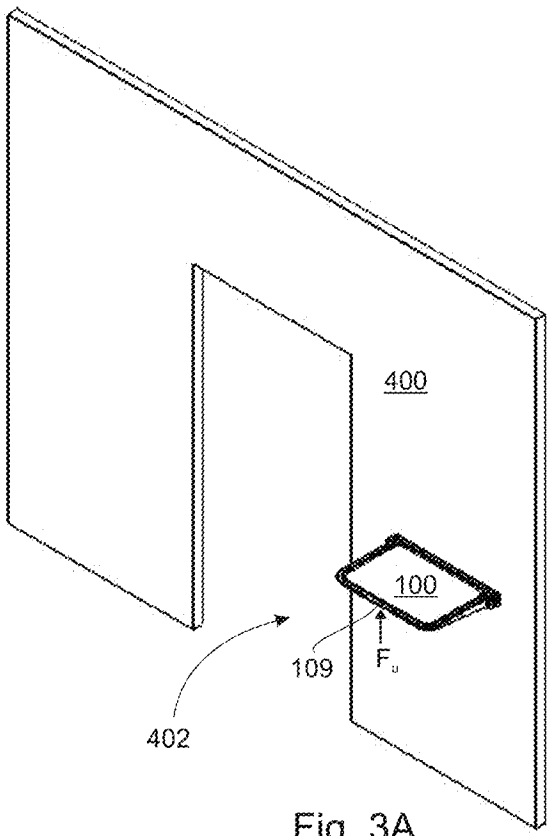
FIG. 3A is a top isometric view of the shelf assembly depicted in FIG. 1 and FIG. 2 mounted on a wall in the open position.

As seen in FIG. 3A, the shelf 100 is horizontal when in the open position on the wall 400. When the shelf 100 is in the open position the ridge 108 is below and to the rear of the shelf 100 and may be relatively inaccessible to a body part. To initiate movement of the shelf 100 back to the closed position, a body part, for example an elbow or hand, preferably an elbow, may be used to engage the bottom surface of the shelf 100 proximate the front edge, for example proximate the grip 109. As shown in FIG. 3A, an upward force $F_u$ applied upwardly under the front edge of the shelf 100 will initiate pivoting of the shelf 100 in an upward direction to return the shelf 100 to the closed position.

As shown in FIG. 2B, countersunk screw holes 107 are provided on a rear face of the shelf (shown at 104) and pass through an upper shelf portion 100*a* into a lower shelf portion 100*b* so that screws (not shown) may be used to secure the upper and lower shelf portions 100*a* and 100*b* together so as to form the shelf 100. Additionally, the upper and lower shelf portions 100*a* and 100*b* may have a snap fit connection about other portions of their periphery. The rear face 104 has an abutment member 111 thereon whose shape may be similar to the lower edge of the mounting bracket 200. The abutment member 111 may be an arcuate projection positioned to abut a wall mounting portion 205 of the mounting bracket 200 so as to brace the shelf 100 in the open position, preventing the shelf 100 from pivoting further downward. By providing the abutment member 111 as a projection from the rear face 104 of the shelf, some clearance is provided for debris that inadvertently adheres to the rear face 104 or to the wall mounting portion 205 of the mounting bracket 200. Without this clearance, such debris could become pinched between the shelf 100 and the mounting bracket 200 when the shelf 100 is moved to the open position, thereby risking gouging or otherwise damaging the surfaces of the mounting bracket 200 and the rear face 104 of the shelf 100.

The mounting bracket 200 comprises screw holes 207 for receiving screws to secure the mounting bracket 200 and hence the shelf assembly to the wall 400. In general, where reference to screws is made in this disclosure, it will be understood that any other suitable way of fastening one member to another may alternatively be used.

The second portion 302 of the torque insert 300 is held in a cap 203 that is releasably held in the mounting bracket 200. More specifically, the caps 203 may be fastened to the bracket ears 201 with screws through screw holes 206. Each bracket ear 201 comprises a U-shaped bearing surface 209 for supporting a locking portion 213 on the corresponding cap 203, which is discussed further below. Each cap 203 further includes a cylindrical bearing wall 215 that is supported on the bearing surface 209 and which supports a bearing projection 120 extending from each side of the shelf 100. As a result, the shelf 100 is supported on the bracket ears 201 without exerting a bending load on the torque inserts 300. Additionally, the engagement between the bearing projections 120 and the bearing wall 215 on the caps 203 seals the torque inserts 300 so as to inhibit migration of debris and moisture into the torque inserts 300.

Figure 4A:
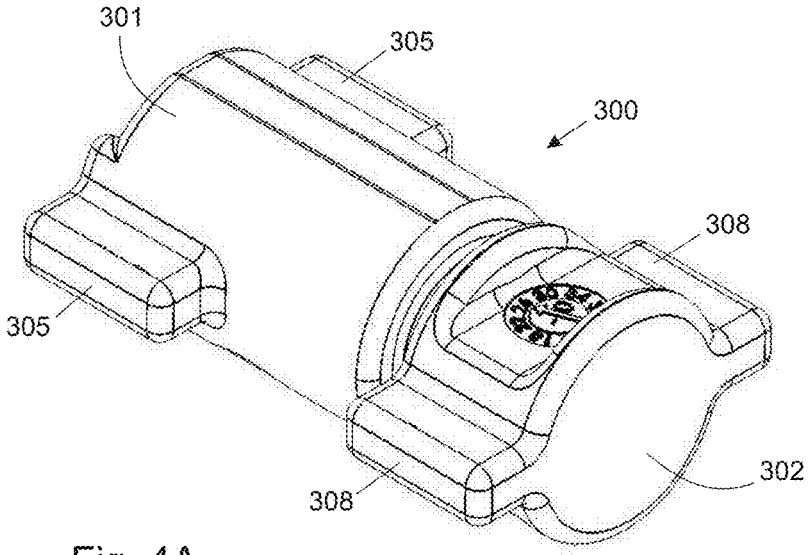
FIG. 4A is an isometric view of a torque insert in the shelf assembly depicted in FIG. 1 and FIG. 2, where the shelf is in the open position.
Figure 4B:
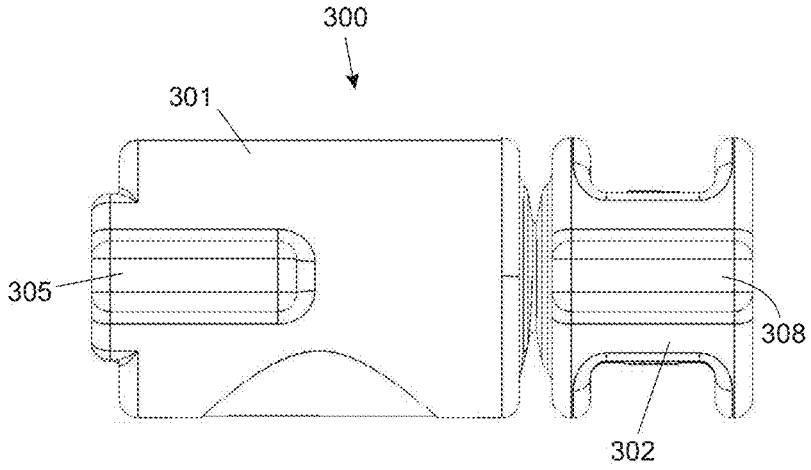
FIG. 4B is a front view of the torque insert of FIG. 4A.

The torque insert 300 and how it mounts in the shelf assembly is shown in more detail in FIGS. 4A-7B. Referring to FIG. 4A a torque insert 300 as described in U.S. reissue patent RE37712 (the contents of which are incorporated fully herein) is shown comprising a first portion 301 for insertion through an aperture in the side of the shelf 100 and a second portion 302 that is external to the shelf 100 when the first portion 301 is inserted into the shelf 100. Referring to FIG. 5D, the first and second portions 301 and 302 are pivotable with respect to each other about a pivot axis that is the shelf pivot axis A. The first portion 301 contains a friction element, which may be, for example, provided by a series of C washers 315 that receive and frictionally engage a torque insert shaft 317 that is integrally formed in the second portion 302 and that extends along the pivot axis A. By way of this frictional engagement, the torque insert 300 is configured to exert a resistance force to lowering of the shelf 100 to the open position such that over a selected range of angles of the shelf 100 the torque insert 300 permits the shelf 100 to fall to the open position under gravity while cushioning the fall. The frictional engagement between the torque insert shaft 317 in the second portion 302 and the C washers 315 in the first portion 301 cushions the pivoting action of the shelf 100 from at least the closed position to the open position, and in some embodiments cushions the pivoting action of the shelf 100 at all points.

The frictional force exerted by the torque insert 300 may be sufficiently high so as to be capable of holding the shelf 100 stationary over a range of angular positions between the open and closed positions. In some embodiments, depending on where the centre of gravity of the shelf 100 is positioned relative to the shelf pivot axis A, gravity may urge the shelf 100 towards the open position, and in such cases, the frictional force may be selected to be sufficiently high to keep the shelf 100 in at least the closed position. In other embodiments however, the shelf 100 may be weighted so that its centre of gravity is positioned closer to the wall 400 than the shelf pivot axis A so as to urge the shelf 100 to remain against the wall 400 when the shelf 100 is in the closed position.

In some embodiments, the range of angles over which the shelf 100 may be permitted to fall under gravity to the open position may be anywhere from a horizontal position to about 80 degrees from horizontal. In other embodiments, the range may be lower (i.e. from a horizontal position to a lesser angle from horizontal), however the shelf 100 may still reliably fall after being urged initially by the user's elbow through only a few degrees of movement because of the momentum imparted to the shelf 100 by the user's elbow.

Tabs 305 on the first portion 301 are mated with corresponding support structures in the shelf 100 to prevent the first portion 301 from rotating relative to the shelf 100 (i.e.

to keep the first portion 301 fixed rotationally with the shelf 100). Thus, the first portion 301 pivots with the shelf 100 when the shelf 100 pivots between positions. Tabs 308 on the second portion 302 are mated with corresponding support structures in the cap of the mounting bracket 200 to prevent the second portion 302 from rotating. Thus, when the shelf 100 pivots, the first portion 301 rotates with shelf 100 but the second portion 302 remains stationary. In FIG. 4A, tabs 305 are shown aligned with tabs 308 as the shelf 100 is in the open position (although they may have any other suitable positional relationship with one another when the shelf 100 is in the open position. When the shelf 100 pivots to the closed position, the orientation of the tabs 308 remains the same as the second portion 302 does not move, but the orientation of the tabs 305 changes by 90-degrees as the first portion 301 rotates with the pivoting shelf 100.

The engagement of the locking portion 213 of the cap 203 with the U-shaped bearing surface 209 of the ear 201, braces the cap against rotation while the resistive force is being exerted by the torque insert 300 to cushion the pivoting of the shelf 100. As a result, the screws that hold the cap 203 in place on the ear 201 do not are not relied upon to brace the cap 203 against rotation, since the forced exerted during bracing between a metallic screw and a polymeric cap 203 could damage the cap 203.

Figure 5A:
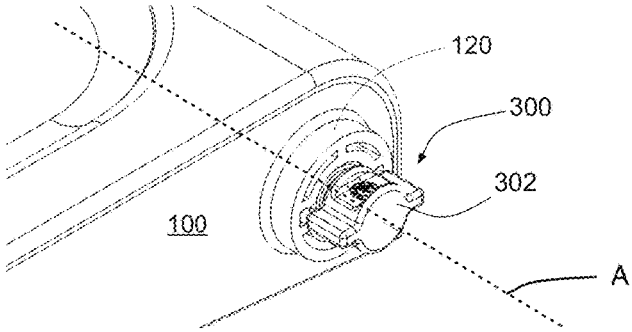
FIG. 5A is an isometric view of the torque insert of FIG. 4A shown in context with a shelf but without a mounting bracket.
Figure 5C:
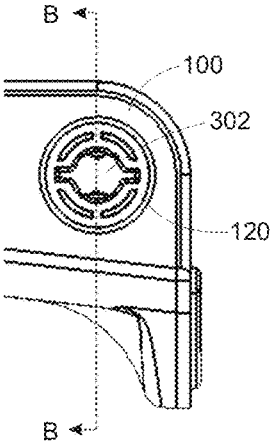
FIG. 5C is a front view of the torque insert of FIG. 4A shown in context with a shelf but without a mounting bracket.
Figure 5B:
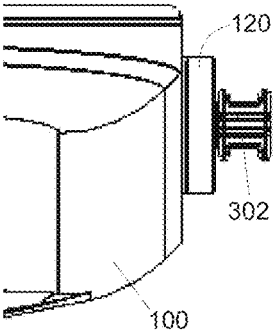
FIG. 5B is a side view of the torque insert of FIG. 4A shown in context with a shelf but without a mounting bracket.
Figure 5D:
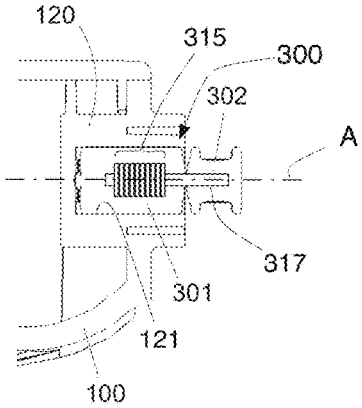
FIG. 5D is front view through cross-section B-B of FIG. 5B.
Figure 6A:
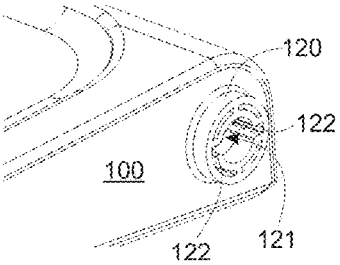
FIG. 6A is an isometric view of a shelf showing a hollow cylindrical boss protruding from a right side of the shelf.

FIGS. 5A-5D show the torque insert 300 with the shelf 100 but without the mounting bracket 200 illustrated. The shelf 100 is in the open position and only one torque insert is shown for the right side of the shelf 100. Another torque insert 300 is utilized on the left side of the shelf 100 in the same manner as described herein. FIG. 6A shows the shelf 100 as depicted in FIG. 5A but without the torque insert.

Referring to FIG. 6A the shelf 100 comprises an aperture 121 in each bearing projection 120 through which the first portion 301 of the torque insert 300 is inserted. The projection 120 also comprises opposed slots 122 configured to receive the tabs 305 (FIG. 4A) of the first portion 301 of the torque insert. The first portion 301 of the torque insert 300 is thus fully supported within the projection 120 within the interior of the shelf 100. The second portion 302 of the torque insert 300 protrudes beyond the projection 120. Since the projection 120 sits in the U-shaped bearing surface of the bracket ear 201, the torque insert 300 itself does not bear any weight from the shelf 100.

Figure 6B:
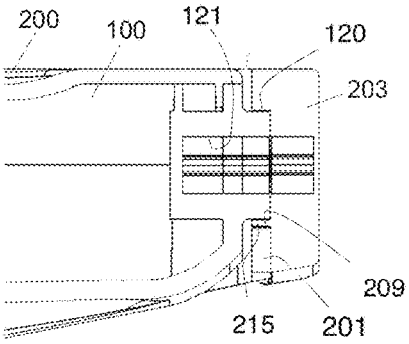
FIG. 6B is a front cross-sectional view of a right side of the shelf assembly of FIG. 1 showing a shelf in context with a mounting bracket.

FIG. 6B depicts how each projection 120 of the shelf 100 is arranged in context with the corresponding bracket ear 201 and cap 203 of the mounting bracket 200. It can be seen that the cap 203 also fits over the projection 120 to help seal the torque insert against intrusion by debris. While the components of the shelf assembly can be made from any suitable material, for example suitable metals and plastics, the cap is preferably made from a self-lubricating plastic, for example Delrin™, and the hollow cylindrical projection 210 is preferably made from a strong plastic, for example a thermoplastic polyamide such as Nylon™.

Figure 7A:
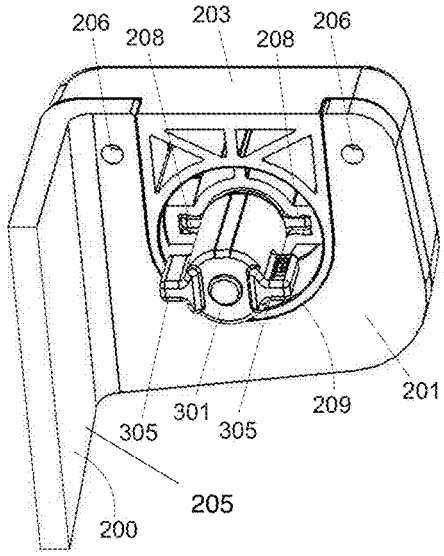
FIG. 7A is an isometric plan view of a torque insert of FIG. 4A shown in context with a mounting bracket but without a shelf.
Figure 7B:
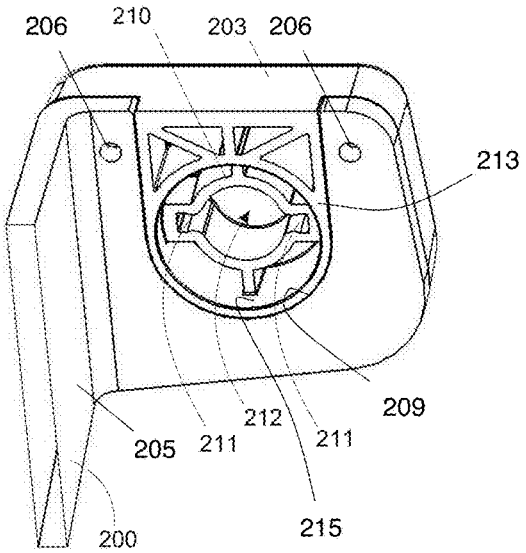
FIG. 7B depicts FIG. 7A without the torque insert.
Figure 7C:
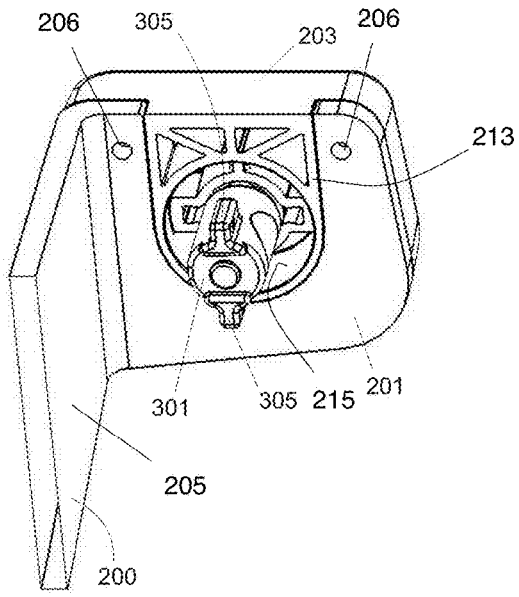
FIG. 7C depicts FIG. 7A as it would appear with a shelf in the closed position.
Figure 7D:
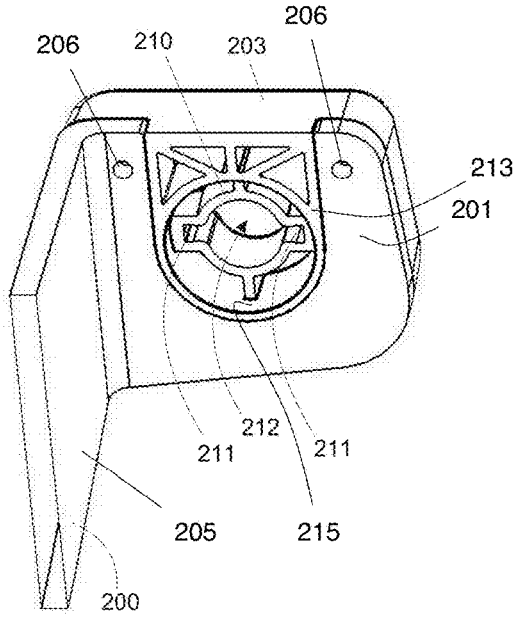
FIG. 7D depicts FIG. 7C without the torque insert.
Figure 8B:
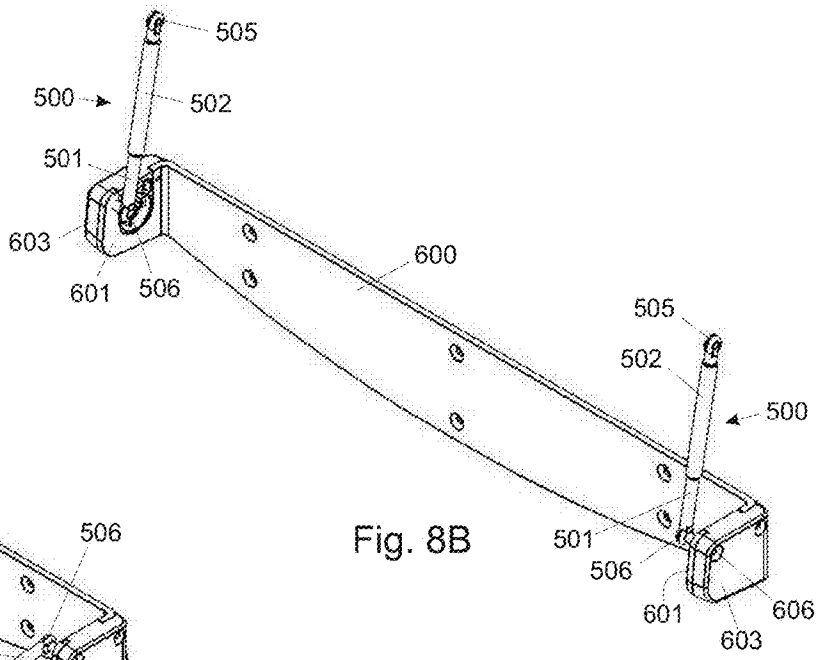
FIG. 8B is an isometric view of the shelf assembly of FIG. 8A with the gas springs in a closed position.
Figure 8C:
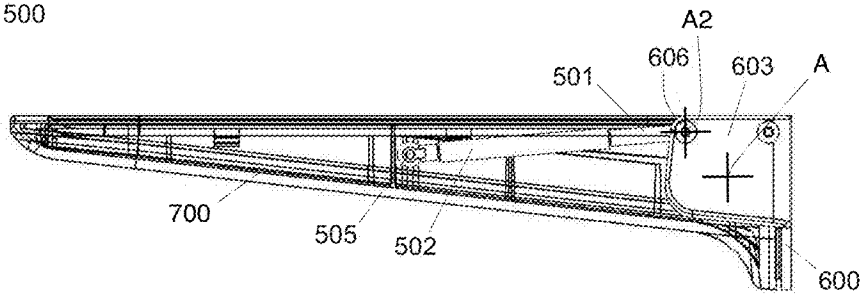
FIG. 8C is a side view of the shelf assembly of FIG. 8A with the shelf shown.
Figure 8A:
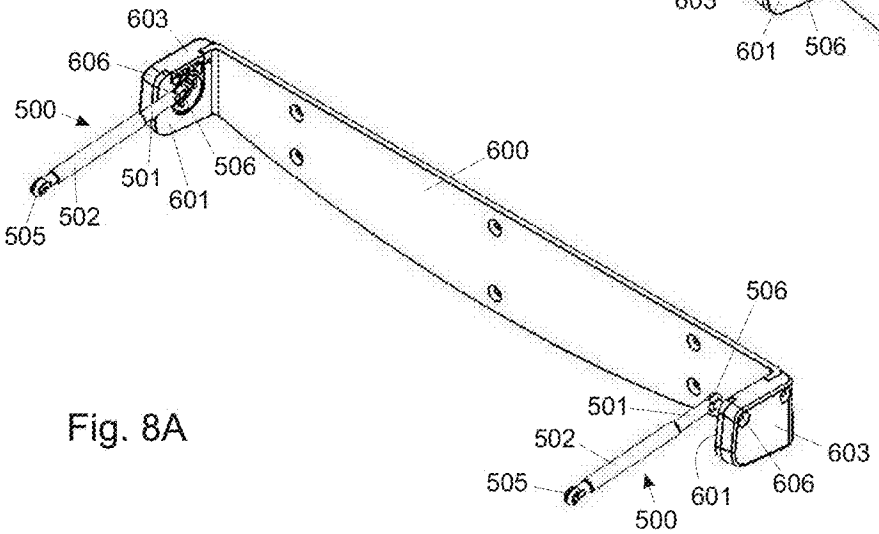
FIG. 8A is an isometric view of an alternate embodiment of a shelf assembly in which gas springs dampen pivoting of a shelf, the springs shown in an open position and the shelf omitted.
Figure 9A:
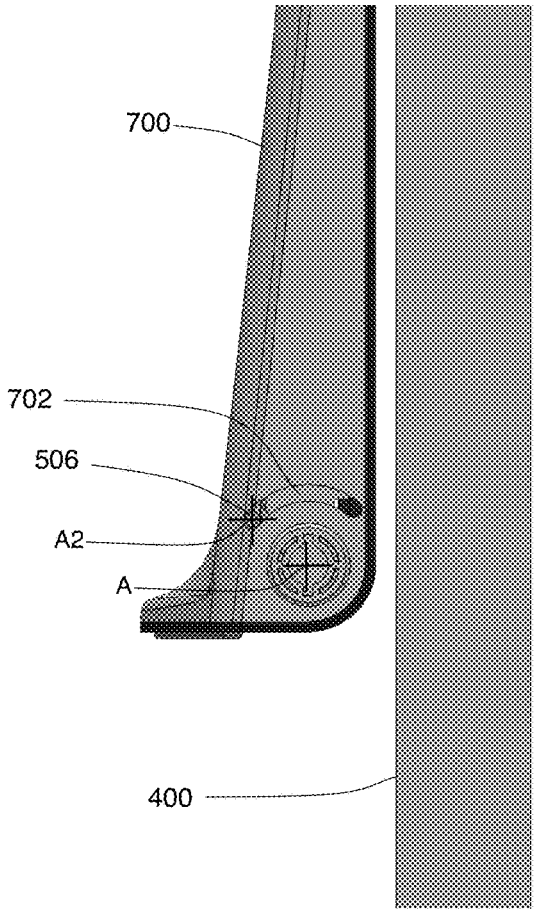
FIG. 9A is a side view of the shelf shown in FIG. 8C without the mounting bracket, in the closed position.
Figure 9B:
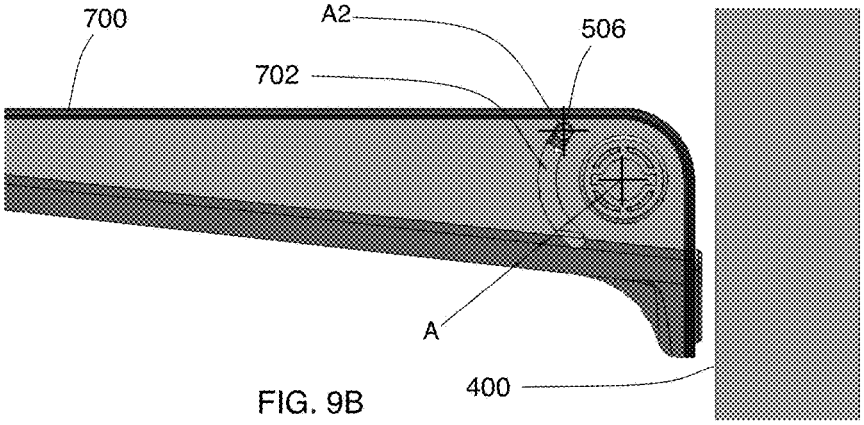
FIG. 9B is a side view of the shelf shown in FIG. 8C without the mounting bracket, in the open position.

Referring to FIGS. 7A-7D, the torque insert 300 is shown in context with the mounting bracket 200 but without showing the shelf 100 for both the open (FIG. 7A) and closed (FIG. 7C) positions of the shelf 100. FIG. 7B and FIG. 7D show the mounting brackets 200 corresponding to FIG. 7A and FIG. 70, respectively, but without the torque inserts showing. The inside of cap 203 comprises a wall 210 that defines an aperture 212 that snugly receives the second portion 302 of the torque insert 300 whereby the tabs 208 of the second portion 302 fit into slots 211 of the aperture 212.

The bracket ears 201 of the mounting bracket 200 each comprise a U-shaped support surface 209 which support one of the caps 203. The cap 203 may be secured to the bracket ear 201 with screws (not shown) through screw holes 206, or by any other suitable fastener. Once the cap 203 is secured to the bracket ear 201, the second portion 302 of the torque insert 300 is restrained from rotation as its tabs 208 are restrained from rotation by the slots 211 in the cap 203. As can be seen by comparing FIG. 7A to FIG. 7C, when the shelf 100 pivots between the open position (FIG. 7A) and the closed position (FIG. 7C), the first portion 301 of the torque insert 300 rotates with the pivoting shelf 100 (represented by showing the first portion 301 in different positions in FIGS. 7A and 7C.

It will be noted that the shelf 100, while having the torque inserts 300 mounted thereto, is substantially sealed to prevent migration therein of debris and liquids that can potentially promote the growth of bacteria. The sealing of the shelf 100 may be provided by a plurality of separate features. One feature is that the upper and lower shelf portions 100*a* and 100*b* may mate sealingly about their peripheral edges. In some embodiments, the aperture 121 may possess an opening (not shown) passing into the interior of the shelf 100, in which case, the presence of the first portion 301 in the aperture 121 may assist in sealing the shelf 100. In other embodiments, the aperture 121 may, as shown in FIG. 5D) be a blind aperture and may have no such opening into the interior of the shelf 100 so that the shelf 100 is sealed while having the torque inserts 300 mounted thereto and also when the torque inserts 300 are not mounted thereto.

It will further be noted that the shelf assembly is free of any arms, cables, linkages or the like connected between the shelf 100 and the mounting bracket 200 and between the shelf 100 and the substantially vertical surface 400. The only elements that connect the shelf 100 to the mounting bracket 200 and the wall 400 are concentric about the shelf pivot axis A. Being concentric about the shelf pivot axis A means that the elements pivot about the axis A or support pivoting movement about the axis A. An example is the torque insert 300, which includes the first portion with the C washers 315 and the second portion with the shaft 317

Referring to FIGS. 1A-7D, the shelf assembly may be assembled and disassembled with ease. To assemble the shelf assembly, the mounting bracket 200 is screwed to the wall at an appropriate height with screws through screw holes 107. The first portions 301 of two torque inserts 300 are inserted the apertures 122 of two cylindrical projections 120 protruding from the left and right sides of shelf 100. Caps 203 are fitted over the second portions 302 of the torque insert 300 and the cylindrical projections 120 on both sides of the shelf 100 are pressed into the U-shaped bearing surfaces 209 of the bracket ears 201 on both sides of the mounting bracket 200. The caps 203 are then secured to the bracket ears 201 with screws through screw holes 206.

Disassembly of the shelf assembly may be carried out by removing the screws from the caps 203 and by lifting the shelf 100 upwards so as to lift the shelf 100, along with the caps 203, from the ears 201 of the mounting bracket 200. The caps 203 can be removed from the second portions 302 of the torque inserts 300 and the torque inserts 300 can be removed from the shelf 100 for replacement if desired. As can be seen, by providing simple disassembly and assembly of the shelf assembly, easy replacement of the shelf 100 and the torque inserts 300 can be carried out quickly.

In another embodiment of the present invention as illustrated in FIGS. 8A-9B, two gas springs 500, (instead of torque inserts), are positioned inside a shelf 700 and form a cushioning structure to cushion pivoting of a shelf 700 from a closed position (FIG. 9A) towards an open position (FIG.

9B) in a shelf assembly. The gas springs 500 comprise pistons 501 in gas-filled cylinders 502. A base end 506 of each piston 501 is pivotally secured to a corresponding bracket ear 601 of mounting bracket 600 via a pin connection (e.g. by pivotally mounting about a bolt, screw or the like that passes through the ear 601 via one of the holes 606), for movement about a pivot axis A2, which is offset from the shelf pivot axis A. The bolt or screw also secures caps 603 to the bracket ears 601. A travelling end 505 of the gas-filled cylinder 502 is pivotally secured to an inner side wall of the shelf 700 for pivotal movement about axis A3. The gas springs 500 may be biased towards a retracted position. Because the pivot axis A2 of the base end 506 is offset from the shelf pivot axis A, pivoting of the shelf 700 between the open and closed positions changes the length of the gas springs 500. In the embodiment shown, the length of the gas springs 500 increases during movement of the shelf 700 towards the open position. When the shelf 700 is urged from a closed (vertically arranged) position to an open, (horizontally arranged) position (or vice versa) the gas springs 500 will resist the forces thereby cushioning the pivoting of the shelf 700. An arcuate slot shown at 702 in FIGS. 9A and 9B permits pivoting of the shelf 700 to occur while providing clearance for the connection of the fixed base end 506 of the gas spring 500 to the bracket ear 601. Other features of this shelf assembly may be similar to the embodiment shown in FIGS. 1A-7D.

In yet another embodiment, the gas springs may be replaced by torsion springs anchored at the same positions on the shelf assembly as the gas springs. The torsion springs provide no spring force when the shelf 700 is in the closed position. In embodiments wherein a type of spring (e.g. a gas spring or a torsion spring) is provided that biases the shelf 400 towards the closed position, as the shelf 700 is moved to the open position the springs provide an increasingly strong biasing force. In order to ensure that the shelf 700 remains in the open position when placed there it may be secured in that position by cooperating securing members, which may be, for example, a magnet mounted to one of the shelf and the mounting bracket, and a magnetically attracted member mounted to the other of the shelf and the mounting bracket. The magnetically attracted member may be, for example, another magnet, or a plate made from a ferromagnetic or ferromagnetic material. In an example, securing the shelf 700 may be conveniently accomplished by mounting a magnet on the rear end of the shelf 700 and a corresponding magnet on the mounting bracket such that the two magnets meet when the shelf 700 is in the open position. The magnets are made strong enough to resist the return force of the torsion springs but sufficiently weak that a relatively small additional force can overcome them when moving the shelf 700 from the open position towards the closed position. Thus, to close the shelf 700, a user can lift up on the bottom of the shelf 700 to break the magnetic anchoring force and allow the shelf 700 to spring back to the closed position.

Novel features of embodiments of the present invention will become apparent to those of skill in the art upon examination of the description of the invention. It should be understood, however, that the scope of the claims should not be limited by the preferred embodiments, but should be given the broadest interpretation consistent with the specification as a whole.

The invention claimed is:

1. A shelf assembly, comprising:

a shelf; and, a mounting bracket for mounting the shelf on a substantially vertical surface, wherein the shelf is pivotably mounted to the mounting bracket proximate a rear end of the shelf for movement about a shelf pivot axis, the shelf pivotable upwardly from an open, substantially horizontal position to a closed, substantially vertical position and downwardly from the closed position to the open position, the shelf comprising an engagement structure in the form of a laterally extending ridge extending outwardly from a bottom face of the shelf, the ridge being shaped to receive an elbow of a user, and positioned in front of the shelf pivot axis such that a generally downward force applied to the engagement structure when the shelf is in the closed position will urge the shelf toward the open position, the shelf further comprising a cushioning structure to cushion pivoting of the shelf from at least the closed position to the open position, the cushioning structure comprising a torque insert that is configured to exert a resistance force to lowering of the shelf to the open position such that over a selected range of angles of the shelf, the torque insert permits the shelf to fall to the open position under gravity, wherein the torque insert includes a first portion held in an aperture in the shelf and a second portion held in a cap that is releasably held in the mounting bracket, wherein the first portion is pivotable with respect to the second portion about the shelf pivot axis, wherein the shelf assembly is free of any arms or linkages connected between the shelf and the mounting bracket and between the shelf and the substantially vertical surface, and wherein the shelf has a bearing projection on each side, wherein the bearing projection is supported by a bearing wall on the cap and wherein the bearing wall of the cap is supported by a bearing surface on the mounting bracket.

2. The shelf assembly according to claim 1, wherein the laterally extending ridge is not substantially higher than the shelf pivot axis when the shelf is in the closed position.

3. The shelf assembly according to claim 2, wherein the laterally extending ridge is at approximately the same height as the shelf pivot axis when the shelf is in the closed position.

4. The shelf assembly according to claim 1, wherein the shelf comprises an abutment member that extends from a rear end of the shelf and abuts at least one of the substantially vertical surface and the mounting bracket to hold the shelf in the open position.

5. The shelf assembly according to claim 1, wherein the only elements that connect the shelf to the mounting bracket and the wall are concentric about the shelf pivot axis.

6. The shelf assembly according to claim 1, wherein the ridge extends proximate a first side of the shelf to proximate a second side of the shelf.

7. The shelf assembly according to claim 1, wherein the cushioning structure can hold the shelf at at least one intermediate position between the closed and open positions.

8. The shelf assembly according to claim 1, wherein the shelf with the first portion of the torque insert connected thereto is substantially sealed.

9. The shelf assembly according to claim 1, wherein the bearing projection and the bearing wall together surround the torque insert and inhibit the migration of debris into the torque insert.

10. The shelf assembly according to claim 9, wherein the bearing projection on the shelf, the bearing wall on the cap and the bearing surface on the mounting bracket together support the shelf on the mounting bracket and prevent the shelf from applying a bending load on the torque.

11. The shelf assembly according to claim 1, wherein the cushioning structure comprises a spring.

12. The shelf assembly according to claim 11, wherein the spring is inside the shelf.

* * * * *